US006139637A

United States Patent [19]

Takahashi et al.

[11] Patent Number: 6,139,637

[45] Date of Patent: Oct. 31, 2000

[54] COATING DEVICE

[76] Inventors: Susumu Takahashi; Hisakazu Kawai, both of 1-10-10 Nishihommachi, Nishi-ku, Osaka-shi, Osaka, Japan

[21] Appl. No.: 08/890,708

[22] Filed: Jul. 11, 1997

[51] Int. Cl.[7] ..... B05C 3/02

[52] U.S. Cl. ..... 118/410; 118/712

[58] Field of Search ..... 222/559, 561; 251/62, 326, 328; 118/410, 419, 712

[56] References Cited

U.S. PATENT DOCUMENTS 4,687,137 8/1987 Boger et al. .
5,056,687 10/1991 Claasen ..... 118/410

FOREIGN PATENT DOCUMENTS 62-266157 11/1987 Japan .
7-68208 3/1995 Japan .
8-141466 6/1996 Japan .

*Primary Examiner*—Brenda A. Lamb
*Attorney, Agent, or Firm*—Wenderoth, Lind & Ponack, L.L.P.

[57] ABSTRACT

To instantaneously stop a coating solution discharged from a discharge port and to make uniform a film thickness of a coated film from a leading end to a trailing end, a slender discharge port facing a base material transfer path is formed at a finish end of a path for a coating solution formed at an inner portion of a die main body. A shutter for opening or closing the discharge port is installed on an outer side of the die main body, and a driving device for making the shutter extend or retract between an open position and closed position is installed.

10 Claims, 16 Drawing Sheets

COATING DEVICE

BACKGROUND OF THE INVENTION

1. Field of the Invention

The present invention relates to a coating device for forming uncoated regions elongated in the transverse direction of a base material among contiguous coated films by intermittently discharging a coating solution from a slender discharge port toward the transferring base material.

2. Description of Related Art

There has been a conventional publicly-unknown coating device for carrying out coating intermittently as is illustrated in FIG. 16. The coating device 1 is provided with a backing roll 2 on the outer peripheral face of which a base material transfer path R is formed and which is driven to rotate in the direction of an arrow E and a die main body 3 intermittently discharging a coating solution toward the base material transfer path R. According to the die main body 3, a slender discharge port 4 facing the base material transfer path R is extended along the transverse direction of the base material transfer path R at a trailing end of a path 5 for a coating solution which is formed at the inner portion of the die main body 3. The die main body 3 is provided with an opening and closing valve 6 for opening and closing the path 5 for a coating solution. A primary manifold 5*a* is formed in the path 5 for a coating solution upstream from the opening and closing valve 6 and a secondary manifold 5*b* is formed therein downstream from the opening and closing valve 6. When a coating solution is pressurized and supplied from a coating solution supply pump, not illustrated, to the primary manifold 5*a*, the opening and closing valve 6 distributes the coating solution uniformly to all the open regions of the path 5 for the coating solution and discharges the coating solution uniformly from all the regions in the longitudinal direction of the discharge port 4 toward the base material transfer path R According to the coating device 1, if the opening and closing valve 6 of the die main body 3 is opened for a predetermined period of time during which the base material W comprising paper, plastic film, metal foil or the like that is backed by the backing roll 2, is being transferred coating films A are formed by coating the coating solution from the discharge port 4 onto the base material W and if the opening and closing valve 6 is closed for a predetermined period of time, uncoated regions B are formed on the base material W by stopping the discharge of the coating solution from the discharge port 4. By repeating the opening and closing operation of the opening and closing valve 6 the uncoated regions B in a strip-like shape elongated in the transverse direction of the base material W are formed on the surface of the base material W by a desired strip width dimension C at given intervals.

Meanwhile, even if the path 5 for the coating solution is closed by the opening and closing valve 6, the coating device 1 cannot immediately stop the coating solution from discharging from the discharge port 4. The reason is that the coating solution under a pressurized state passes through the path 5 for the coating solution before closing the opening and closing valve 6 and therefore, even if the opening and closing valve 6 is closed, the coating solution starts to leak from the discharge port although the amount thereof is very small, until the coating solution remaining in the path 5 for the coating solution downstream from the opening and closing valve 6, is decompressed.

However, the leakage of the small amount of the coating solution from the discharge port 4 after closing the opening and closing valve 6, poses a problem where a portion having a thin film thickness is formed at a trailing end Aa of the coated film A formed on the base material W and the film thickness of the coated film A cannot be made uniform from the leading end to the trailing end thereof.

SUMMARY OF THE INVENTION

Hence, it is an object of a first aspect and a second aspect of the present invention to provide a coating device capable of instantaneously stopping a coating solution from discharging from a discharge port in order to solve the above-described problem.

It is an object of the second and a third aspect of the present invention to provide a coating device capable of firmly cutting off a coating solution at a discharge port when the discharge of coating solution is stopped.

It is an object of a fourth aspect of the present invention to provide a coating device capable of making the thickness of a coated film uniform from start to finish.

It is an object of a fifth aspect of the present invention to provide a coating device capable of constituting a predetermined relationship between coating positions of both faces of a base material when intermittent coating is carried out on one face of the base material of which the other face has been intermittently coated.

According to the first aspect of the present invention, there is provided a coating device in which a slender discharge port facing a base material transfer path is formed at a finish end of a path for a coating solution formed at an inner portion of a die main body, wherein a shutter for opening and closing the discharge port is installed and a driving device for making the shutter extend and retract between an open position and a closed position is installed outside of the die main body.

According to the first aspect of the present invention, when the shutter is made to retract to the open position by the driving device, the coating solution can be discharged from the discharge port and when the shutter is made to extend swiftly to the closed position by the driving device, the discharge port is closed whereby the discharge of the coating solution can be stopped instantaneously.

According to the second aspect of the present invention, there is provided a coating device in which a slender discharge port facing a base material transfer path is formed at a finish end of a path for a coating solution formed at an inner portion of a die main body. The path for a coating solution is formed also between a fixed portion of the die main body and a movable valve provided to the die main body. The discharge port is formed by a front end edge of the fixed portion of the die main body and a front end edge of the valve. A valve seat for seating and unseating the valve is installed at a portion of the fixed portion of the die main body facing the path for a coating solution along the transverse direction of the path for a coating solution. The valve is arranged such that a volume of the path for a coating solution downstream from the valve seat is increased as the valve moves from an unseated position opening the path for a coating solution toward a seated position closing the path for a coating solution, and a driving device for making the valve extend and retract between the unseated position and the seated position is installed.

According to the second aspect of the present invention, when the valve is made to extend to the unseated position by the driving device, the coating solution can be discharged from the discharge port by opening the path for the coating solution and when the valve is swiftly retracted to the seated position by the driving device, the path for the coating solution is closed whereby the volume of the path for the coating solution downstream from the valve seat is increased and the coating solution in the proximity of the discharge port is decompressed and the discharge of the coating solution at the discharge port can be stopped instantaneously. In the procedure where the valve is being seated on the valve seat, the passing resistance at a narrow gap formed between the valve and the valve seat immediately before seating the valve is considerably increased whereby the passage for the coating solution is substantially closed and during a time period from this state until the valve is moved toward the seating position and is seated, the path for the coating solution is substantially closed and further the volume of the path for the coating solution downstream from the valve seat is increased. Accordingly, the solution can be cut off firmly by decompressing the coating solution in the proximity of the discharge port.

According to the third aspect of the present invention, there is provided the coating device in accordance with the second aspect wherein the seating portion of at least one of the valve seat and the valve is formed by an elastic member whereby the valve starting to be seated on the valve seat can further be moved in the seating direction while the valve is compressing to deform the elastic member.

According to the third aspect of the present invention, the valve immediately after having seated on the valve seat is further moved in the seating direction while compressing to deform the elastic member whereby the solution can firmly be cut off by decompressing the coating solution in the proximity of the discharge port by increasing the volume of the path for the coating solution downstream from the valve seat.

According to the fourth aspect of the present invention, there is provided the coating device in accordance with the first, or second or third aspect of the present invention wherein a manifold is formed at a midpoint of the path for a coating solution upstream from the valve seat and both ends of the manifold are communicated with a solution discharge path.

According to the fourth aspect of the present invention, a portion of the coating solution is discharged to the solution discharge path from both ends of the manifold and therefore, a large amount of the coating solution can be supplied to the manifold and the pressure variation of the coating solution in the path for the coating solution can be decreased even with the opening or closing of the shutter or the seating or unseating of the valve whereby the coating solution can be discharged uniformly from start to stop of coating.

According to the fifth aspect of the present invention, there is provided the coating device in accordance with the first, second, third or fourth aspect of the present invention, wherein the driving device is operated based on a detecting signal from a detecting device for detecting one end position and the other end position of a coated film which has already been coated on one face of the base material passing through the base material transfer path.

According to the fifth aspect of the present invention, the driving device is operated based on the detecting signal from the detector for detecting one end position and the other end position of the coated film which has already been coated on one face of the base material whereby the coating is carried out and therefore, the positional relationship of the coated films coated on both faces of the base materials can be constituted in a predetermined way.

DETAILED DESCRIPTION OF PREFERRED EMBODIMENTS

An explanation will be given of a coating device (hereinafter, invented device) in accordance with the present invention based on embodiments shown by the drawings as follows.

Embodiment 1

Figure 1:
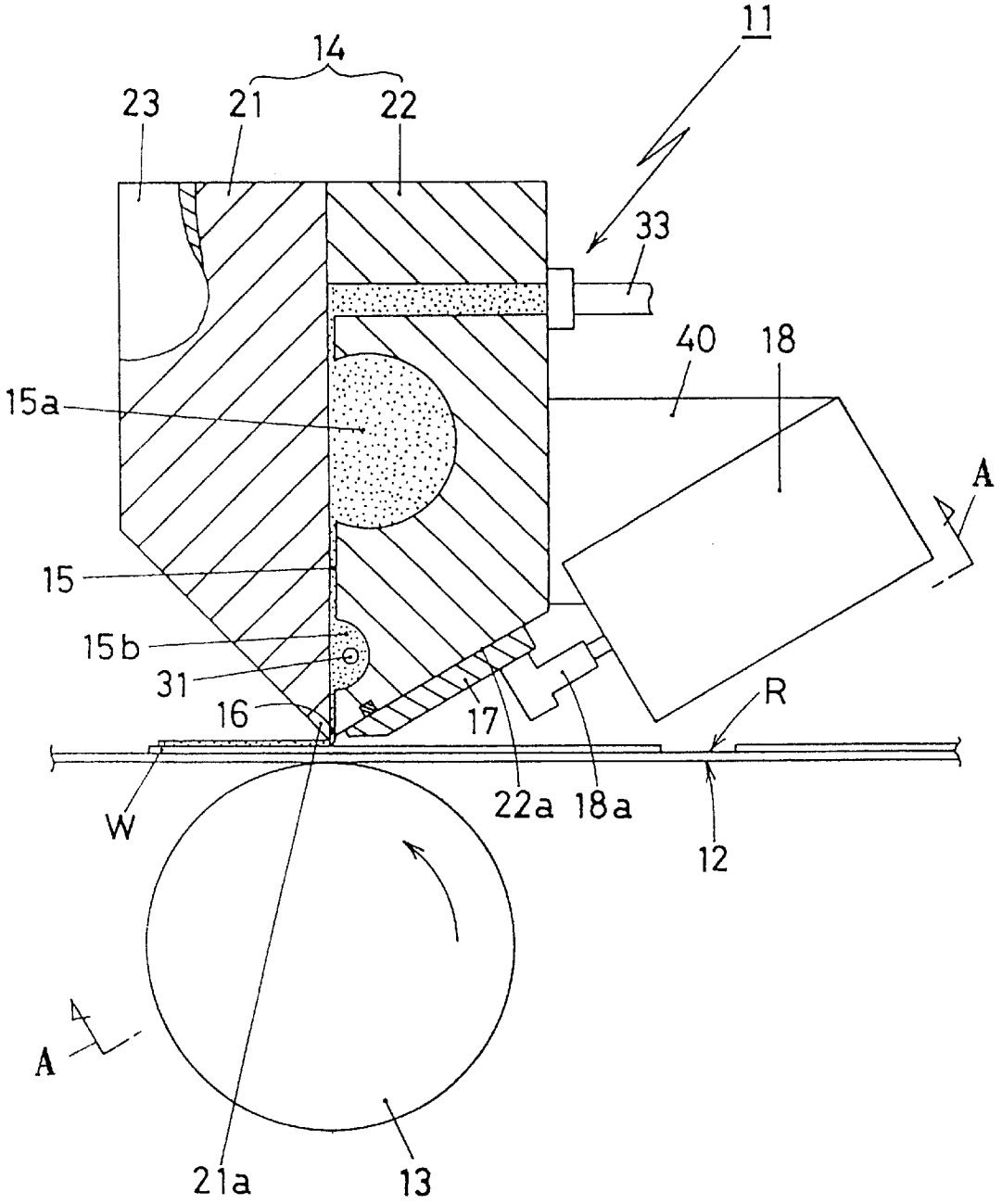
FIG. 1 is a side view showing a first embodiment of the present invention in which a die main body and a shutter are viewed partially in section along a transfer direction of a base material.
Figure 2:
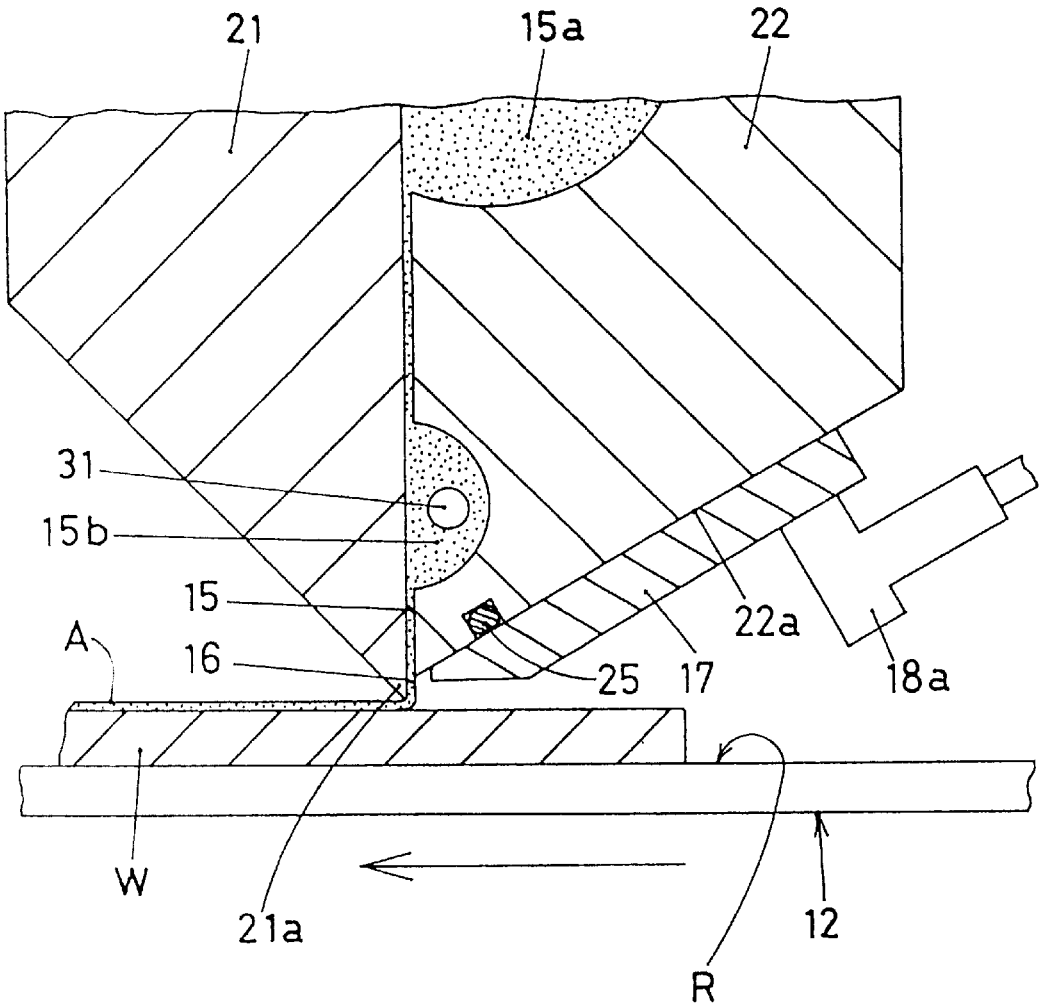
FIG. 2 is a magnified, partially sectional side view showing essential portions of the first embodiment in a state where the shutter is made to retract to an opening position and a coating solution is discharged from a discharge port.
Figure 3:
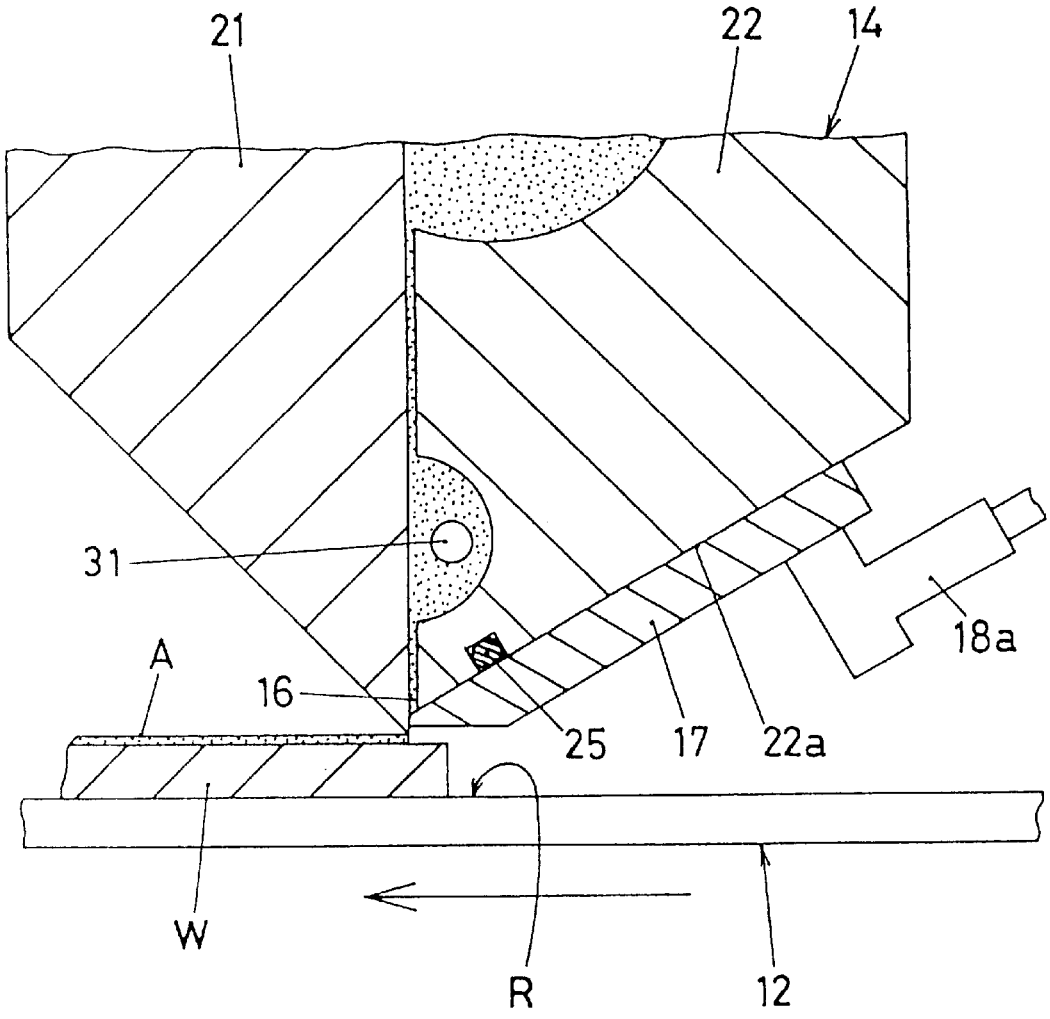
FIG. 3 is a magnified, partially sectional side view showing essential portions of the first embodiment in a state where the shutter is made to extend to a closing position and the discharge of the coating solution is stopped.
Figure 4:
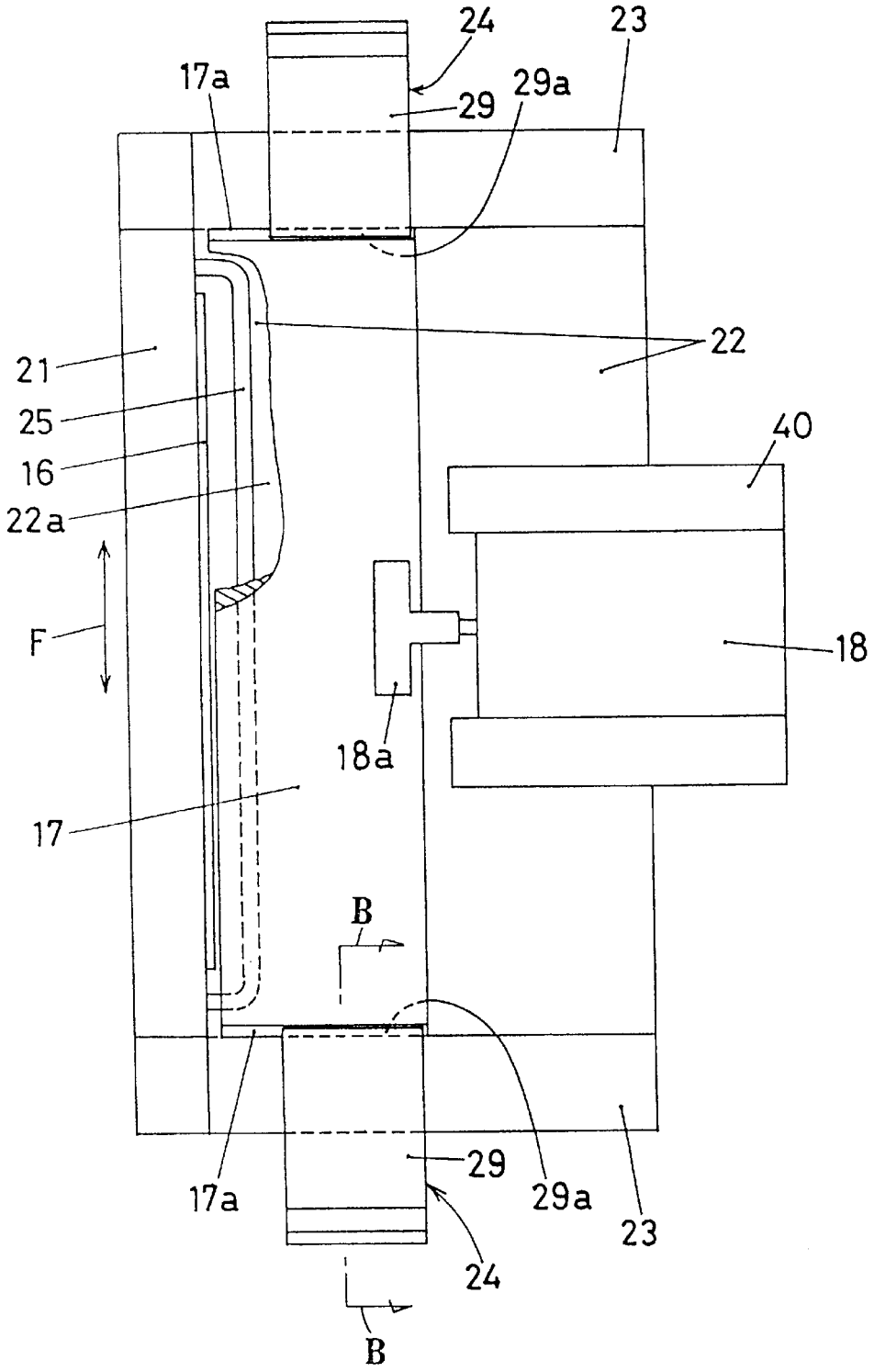
FIG. 4 is a bottom view along lines A—A of FIG. 1, but omitting a back-up roll, a transfer device and the base material.
Figure 5:
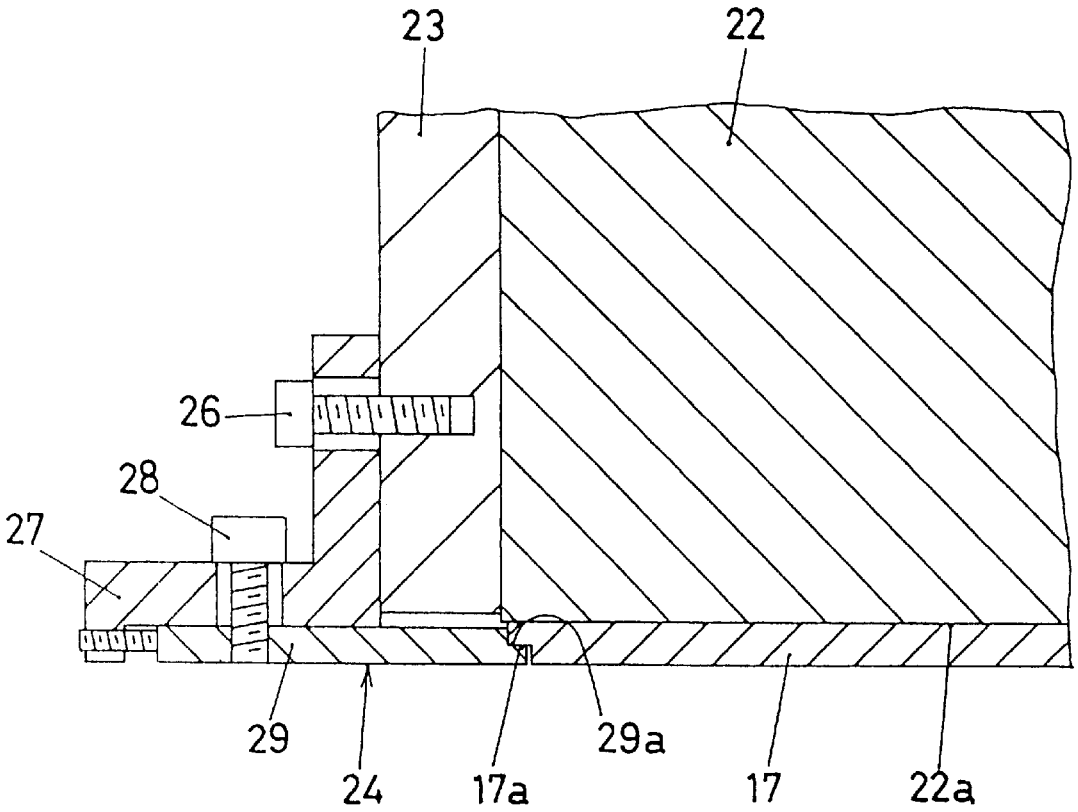
FIG. 5 is an enlarged sectional view of a guide device taken along lines B—B of FIG. 4.
Figure 6:
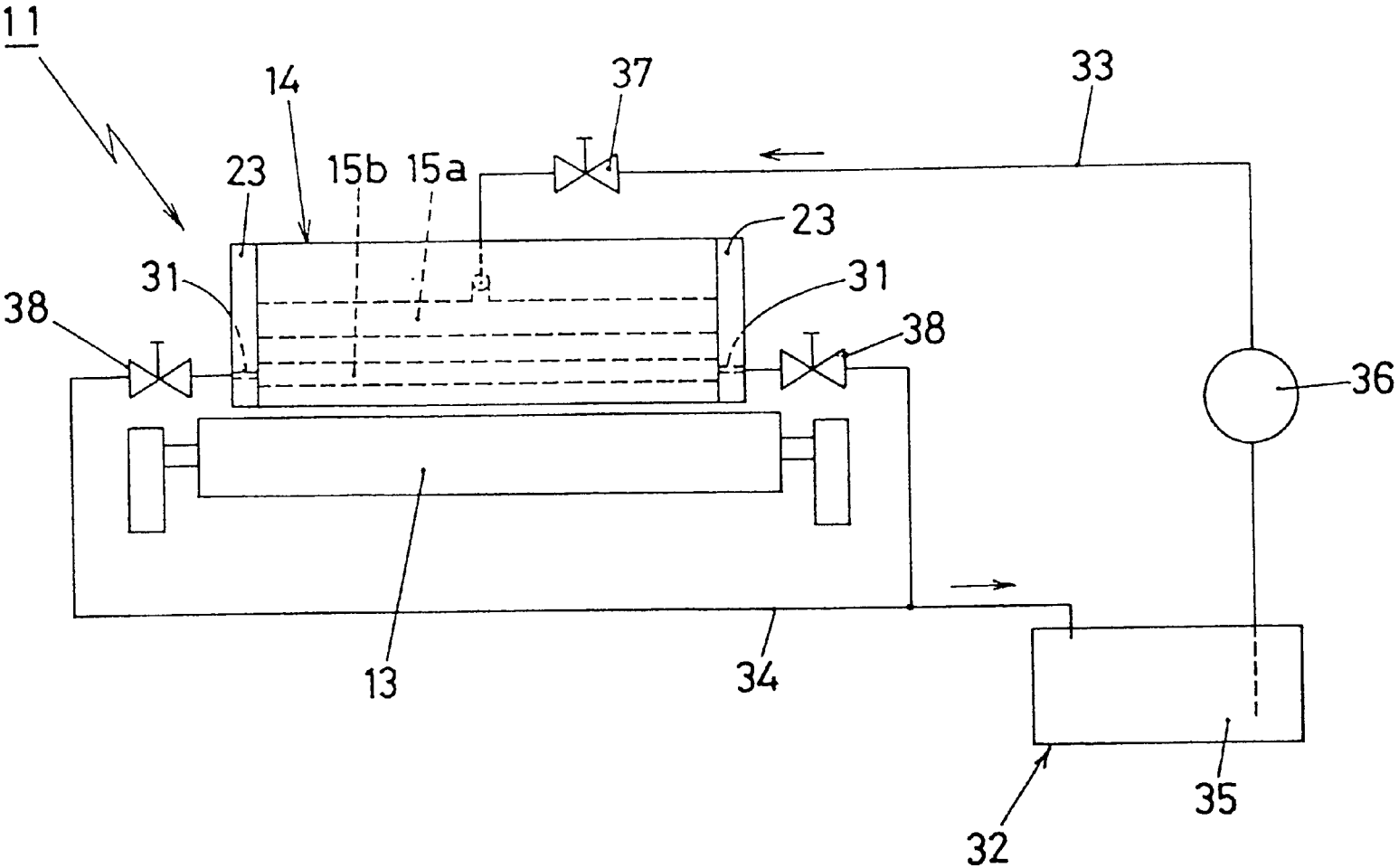
FIG. 6 is a schematic diagram of pipings for the coating solution in the first embodiment.

FIGS. 1 through 6 show Embodiment 1 of the invented device in which FIG. 1 is a side view showing a die main body and a shutter in section along a transfer direction of a base material, FIG. 2 is an enlarged, partially sectional side view showing essential portions in a state where the shutter is made to retract to an open position and a coating solution is discharged from a discharge port, FIG. 3 is an enlarged, partially sectional side view showing essential portions in a state where the shutter is made to extend to a closing position and the discharge of a coating solution is stopped, FIG. 4 is a bottom view along arrows A—A of FIG. 1 showing the device by omitting a back-up roll, a transfer device and the base material, FIG. 5 is an enlarged sectional view of a guide device along lines B—B of FIG. 4, and FIG. 6 is a schematic diagram of pipings for the coating solution.

As illustrated by FIG. 1 a coating device 11 in accordance with this embodiment is provided with a transfer device 12 comprising a belt conveyer etc. forming a base material transfer path R on the upper face side, a back-up roll 13 of the transfer device 12 and a die main body 14 arranged above the back-up roll 13. The die main body 14 is constituted by bonding lip members 21 and 22 and two end plates 23. A slender discharge port 16 facing the base material transfer path R is extended along the transverse direction (direction of arrows F in FIG. 4) of the base material transfer path R at a trailing end of a path 15 for a coating solution that is formed at a coupling portion of the lip members 21 and 22. In the die main body 14 a shutter 17 for opening and closing the discharge port 16 and a driving device 18 for making the shutter 17 extend and retract are attached to the outside of the lip member 22. A front end edge 21 a of the lip member 21 constitutes a doctoring edge for forming a predetermined coating gap between the lip member 21 and the base material W.

The shutter 17 is brought into abrasive (i.e. frictional) contact with a slanted side face 22*a* of the lip member 22 and stepped portions 17*a* provided at both edges of short sides thereof are guided by guiding devices 24. The shutter 17 and the lip member 22 are sealed by a seal member 25 embedded in the lip member 22 whereby a coating solution invading a gap between the shutter 17 and the lip member 22 from the discharge port 16 is prevented from leaking to the outside.

As shown by FIG. 5, each of the guiding devices 24 is provided with a bracket 27 that is fastened by a screw 26 to the end plate 23 adjustably in respect of the height, and a guide plate 29 fastened by a screw 28 to the bracket 27 and the stepped portion 17*a* of the shutter 17 is abrasively (i.e. frictionally) guided by a stepped portion 29*a* provided at a side edge of the guide plate 29. As illustrated by FIG. 1 and FIG. 4, the driving device 18 for driving the shutter 17 to extend and retract uses a solenoid, or a linear motor, or super-magnetostrictive actuator, etc., and an output end 18*a* thereof is bonded to the shutter 17. The shutter 17 is swiftly made to extend and retract by the driving device 18 between an open position (refer to FIG. 2) opening the discharge port 16 and a closing position (refer to FIG. 3) completely closing the discharge port 16.

The path 15 for a coating solution is formed with a primary manifold 15*a* on the upstream side and a secondary manifold 15*b* on the downstream side as shown by FIG. 1. As illustrated by FIG. 6, both ends of the secondary manifold 15*b* on the downstream side communicate with solution discharge paths 31. From a coating solution supply device 32, a supply pipe 33 is connected to the primary manifold 15*a* and a recirculation pipe 34 is connected to the solution discharge paths 31. The supply pipe 33 is extended from a coating solution tank 35 and at a midpoint thereof a solution feeding pump 36 and a flow rate adjusting valve 37 are installed. Flow rate adjusting valves 38 are installed in the recirculation pipe 34 and the end of the recirculation pipe 34 is connected to the coating solution tank 35.

Next, an explanation will be given of the operation of coating by the coating device 11 in accordance with the embodiment. With regard to the die main body 14, the shutter 17 is made to extend to the closing position (refer to FIG. 3) and the die main body 14 is made to stand ready by bringing the discharge port 16 into the closing state. Next, when the base material W transferred by the transfer device 12 reaches a predetermined coating starting position, the shutter 17 is swiftly made to retract to the opening position (refer to FIG. 2) by operating the driving device 18 and the coating solution is discharged from the discharge port 16 whereby a coated film A is formed on the base material W. Finally, when the transferring base material W reaches a predetermined coating finishing position, the shutter 17 is made to swiftly extend to the closing position E (refer to FIG. 3) by operating the driving device 18 whereby the coating solution is instantaneously stopped from discharging from the discharge port 16.

The arrival of one sheet of the base material W that is formed in predetermined dimensions at the predetermined coating starting position or the coating finishing position is confirmed by sensors, not illustrated, etc. arranged in the vicinity of the transfer device 12. The driving device 18 is operated based on detecting signals issued by the sensors, etc.

As has been explained above, the discharge port 16 of the coating device 11 is instantaneously opened and closed by making the shutter 17 extend or retract swiftly by the driving device 18 and therefore the film thickness of the coated film A can be made uniform from the leading end to the trailing end thereof. Further, in operation of the coating device 11 a portion of the coating solution is discharged from both ends of the manifold 15*b* to the solution discharge paths 31 and therefore, a large amount of the coating solution can be supplied to the manifold 15*b* compared with the case where the solution discharge paths 31 are dispensed with. As a result, the pressure variation of the coating solution present between the manifold 15*b* and the discharge port 16 in the path 15 for the coating solution can be reduced even with the opening or closing of the shutter 17 whereby the coating solution can be discharged from start to stop of coating by which the thickness of the coated film A can be made uniform.

Embodiment 2

Figure 7:
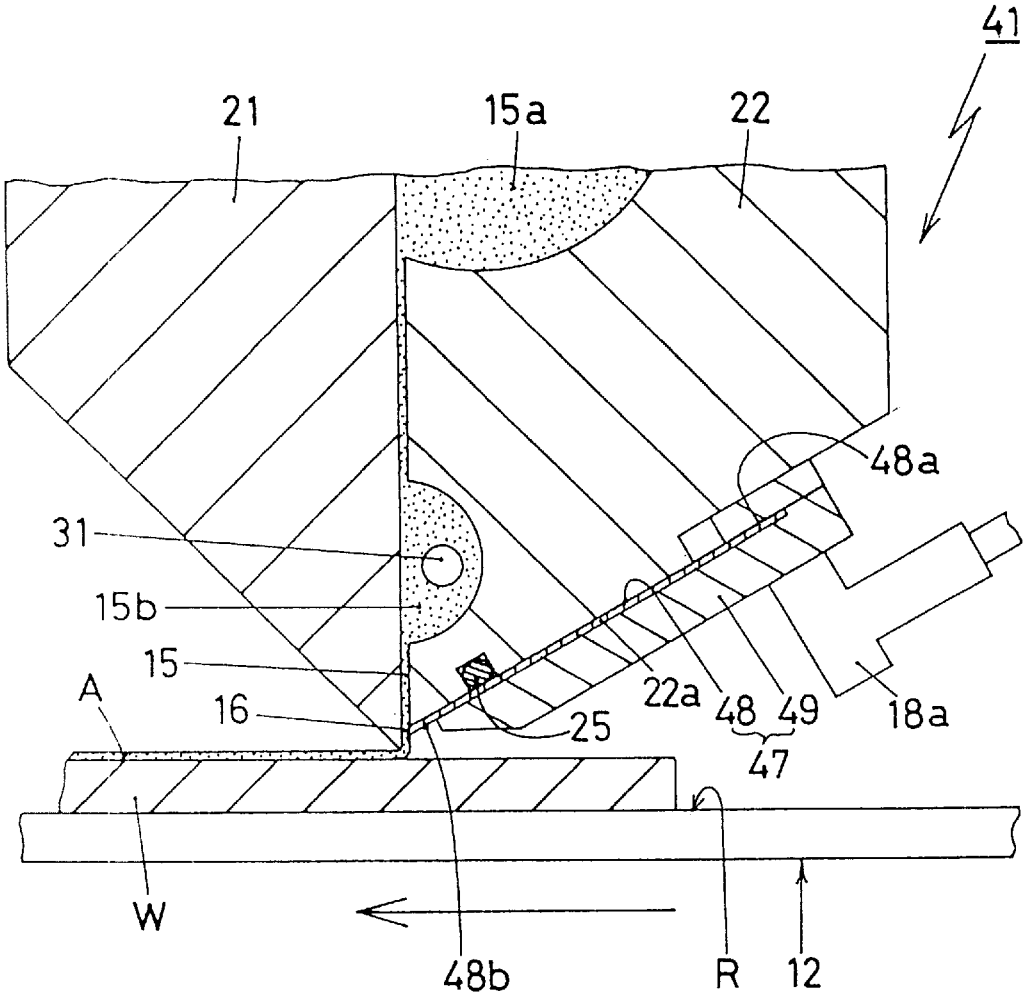
FIG. 7 is an enlarged, partially sectional side view showing essential portions in a state where a shutter is made to regress to the opening position and the coating solution is discharged from the discharge port, according to a second embodiment of the present invention.
Figure 8:
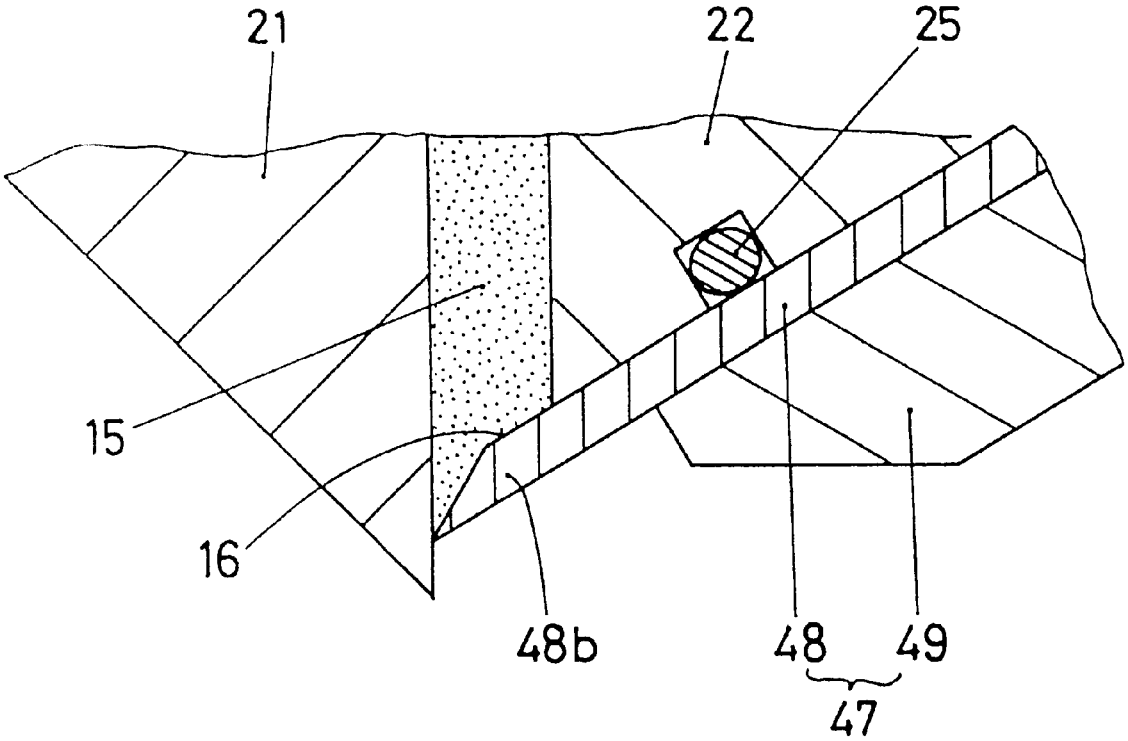
FIG. 8 is a further enlarged, partially sectional side view showing essential portions in a state where the shutter is made to progress to the closing position and the discharge of the coating solution is stopped, according to the second embodiment.

FIG. 7 and FIG. 8 show Embodiment 2 of the invented device where FIG. 7 is an enlarged, partially sectional side view showing essential portions in a state where the shutter is made to retract to the open position and the coating solution is discharged,and FIG. 8 is a further enlarged, partially sectional side view showing the essential portions in a state where the shutter is made to extend to the closing position and the coating solution is stopped from discharging.

The difference between a coating device 41 in accordance with this embodiment and that in the first embodiment, resides in that a shutter 47 is constituted by bonding an elastic thin plate 48 to a thick plate 49 and the discharge port 16 is opened and closed by a front end of the thin plate 48. The constitution of the device other than the shutter 47 is substantially the same as that in Embodiment 1 and the same notations designate the same component members.

Regarding the shutter 47, a rear end 48*a* of the thin plate 48 is bonded to the thick plate 49 and the thin plate 48 is brought into abrasive contact with the inclined outer side face 22*a* of the lip member 22. The discharge port 16 is closed by bringing an inclined tip end 48*b* of the thin plate 48 into contact with the lip member 21 to promote the close contact in respect of the lip member 21 by utilizing the large amount of elastic formation of the inclined tip end 48*b*.

Embodiment 3

Figure 9:
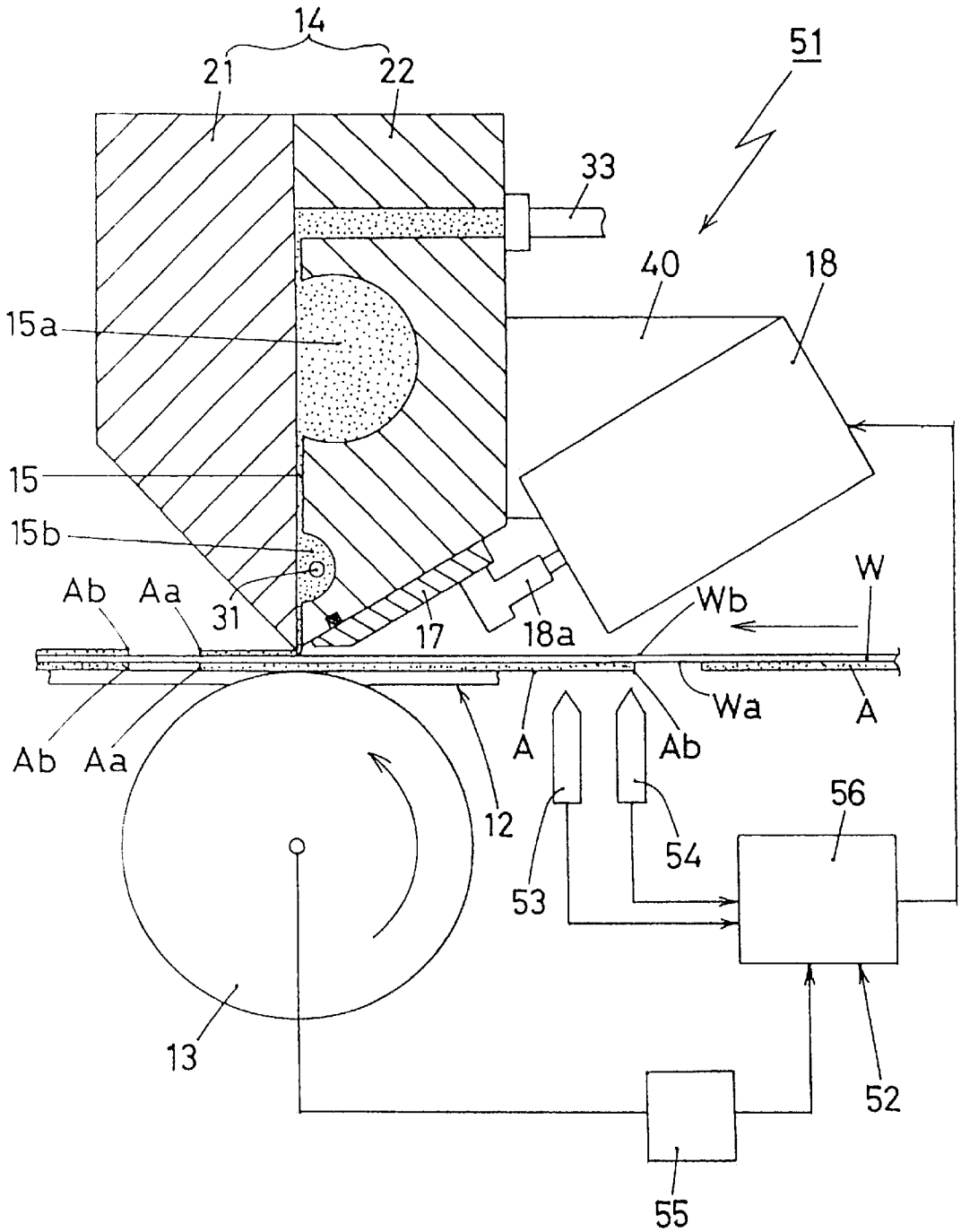
FIG. 9 is a partially sectional side view showing essential portions in a state where the shutter is made to retract to the opening position and the coating solution is discharged from the discharge port, according to a third embodiment of the present invention.

FIG. 9 illustrates Embodiment 3 of the invented device and is a partially sectional side view showing essential portions in a state where the shutter is made to retract to the open position and the coating solution is discharged from the discharge port.

The difference between a coating device 51 in accordance with this embodiment and that in Embodiment 1 resides in that the driving device 18 is operated by a detecting device 52 which detects one end position (leading end) Aa and the other end position (trailing end) Ab of the coated film A which has already been coated on one face Wa of the base material W passing along the base material transfer path R. Other than this constitution, the device is substantially the same as that in Embodiment 1 and the same notations designate the same component members.

The detecting device 52 is constituted by detectors 53 and 54 for detecting the one end position Aa and the other end position Ab of the coated film A which has already been coated on the one face (rear face) Wa of the base material W, a speed detector 55 for detecting a transfer speed of the transfer device 12 and a calculator 56 for outputting an operation signal to the driving device 18 based on detection signals from the detectors 53 and 54 and the speed detector 55. According to the calculator 56, the ends Aa of the coated films A on the rear face Wa and the surface Wb are brought into agreement by outputting the coating starting signal for causing the shutter 17 to be retracted by the driving device 18, according to a predetermined delay time period which is calculated based on the detected speed signal from the speed detector 55 after time points where the end position Aa of the coated film A on the rear face Wa is detected by the detector 53 and thereafter by the detector 54. Further, the other ends Ab of the coated films A on the rear face Wa and the surface Wb are brought into agreement by outputting the coating stopping signal for causing the shutter 17 to be extended by the driving device 18, according to a predetermined delay time period which is calculated based on the detected speed signal from the speed detector 55 after time points where the other end position Ab of the coated film A on the rear face Wa is detected by the detector 54 and thereafter by the detector 53. Incidentally, the calculator 55 can displace the coated films A intermittently coated on both faces Wa and Wb by predetermined dimensions, which is not illustrated.

Embodiment 4

Figure 10:
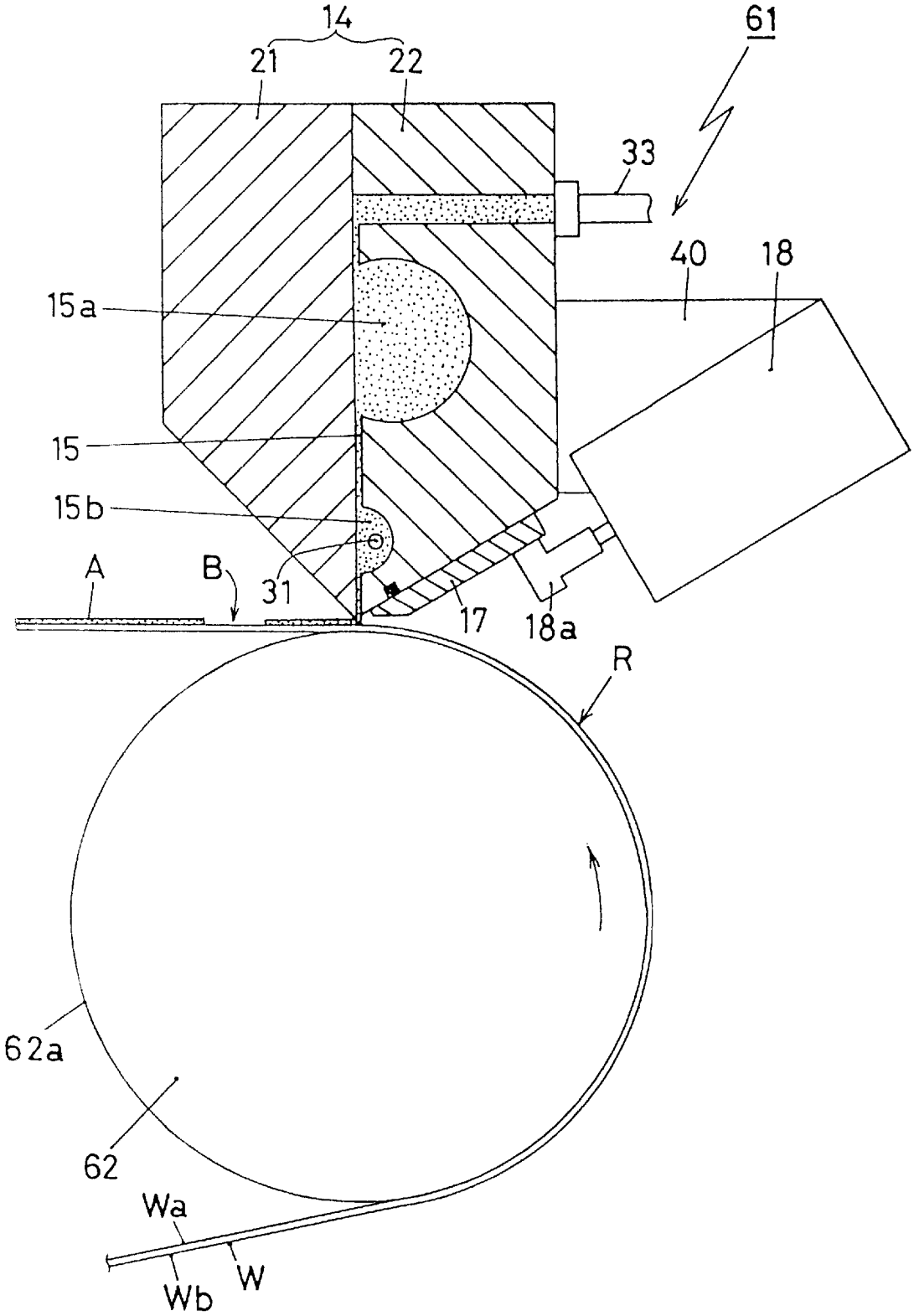
FIG. 10 is a partially sectional side view showing essential portions in a state where the shutter is retracted to the opening position and the coating solution is discharged from the discharge port, according to a fourth embodiment of the invented device.

FIG. 10 illustrates Embodiment 4 of the invented device and is a partially sectional side view showing essential portions in a state where the shutter is made to retract to the open position and the coating solution is discharged from the discharge port.

The difference in a coating device 61 in accordance with this embodiment and that in Embodiment 1 resides in that the base material transfer path R is formed on a surface 62*a* of a back-up roll 62 which is forcibly driven to rotate and the intermittent coating is carried out on the base material W in a continuous strip-like shape. Other than this constitution, the device is substantially the same as that in Embodiment 1 and the same notations designate the same component members. Incidentally, the positional relationship among the coated films A which are intermittently coated on both faces Wa and Wb of the base material W can be made as predetermined by providing the coating device 61 with the detecting device 52 (refer to FIG. 9).

Embodiment 5

Figure 11:
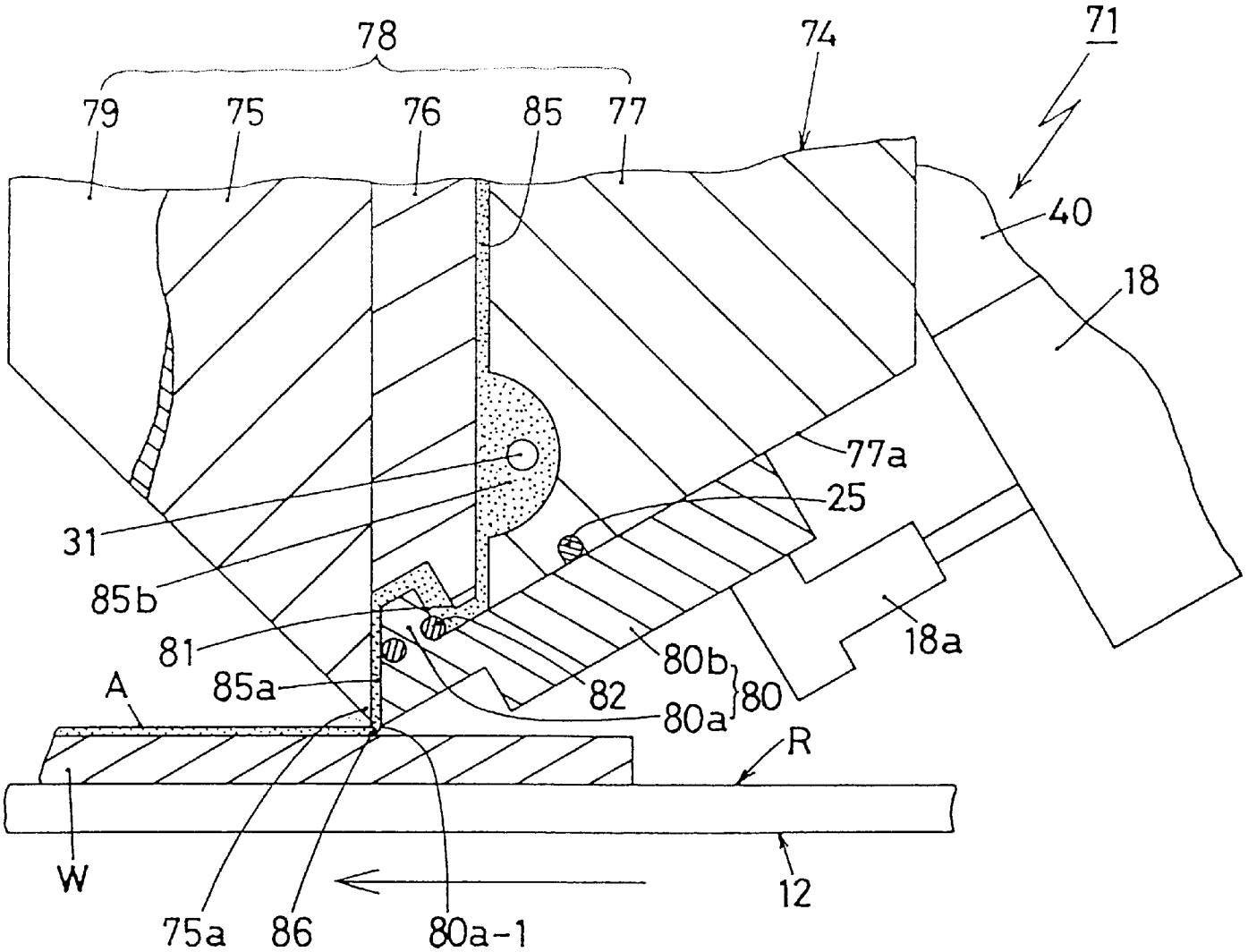
FIG. 11 is an enlarged, partially sectional side view showing essential portions in a state where a valve is extended to an unseated position and a coating solution is discharged from a discharge port, according to a fifth embodiment of the present invention.
Figure 12:
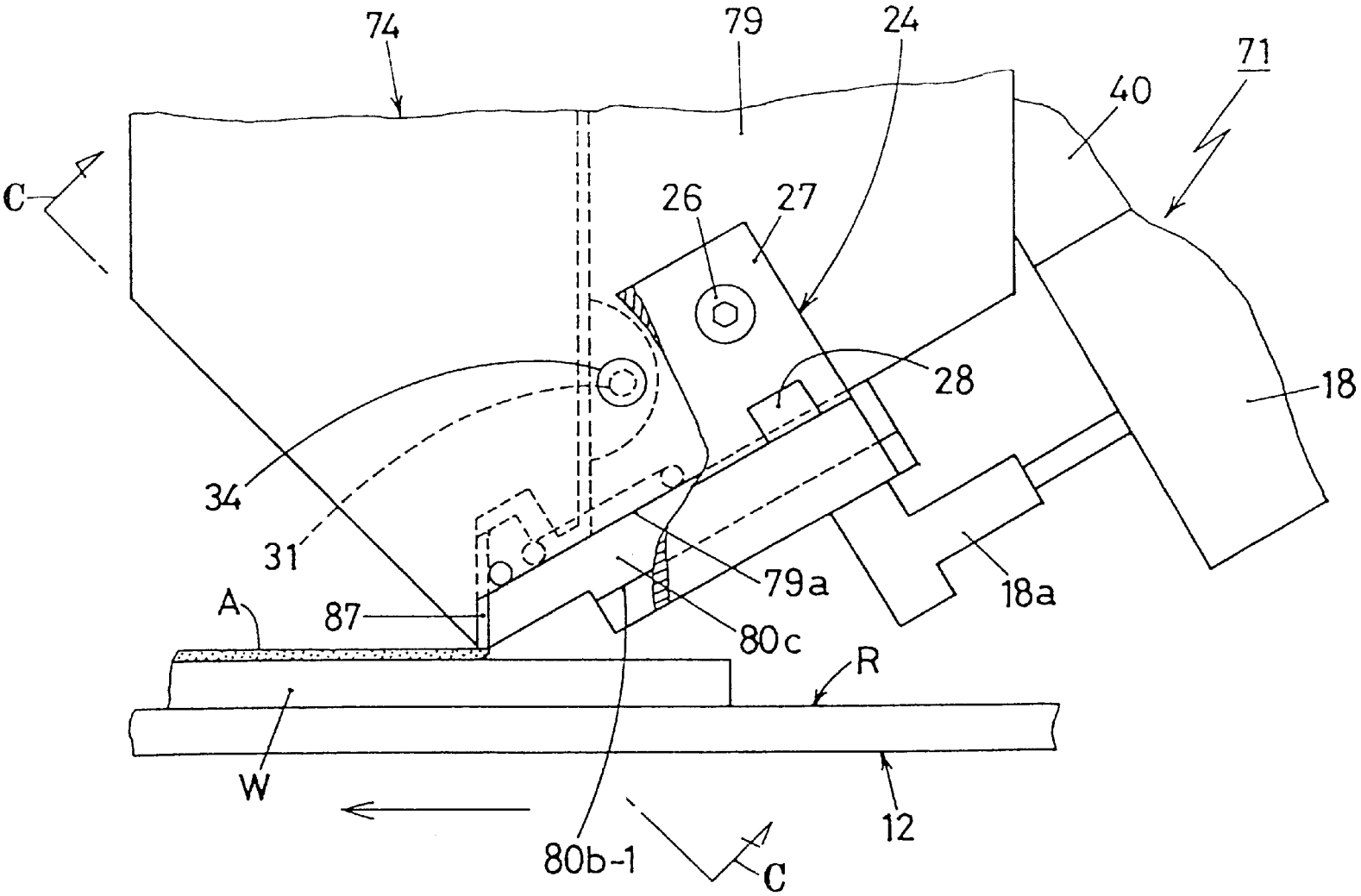
FIG. 12 is an enlarged, partially sectional side view showing essential portions of the fifth embodiment in the same state as shown in FIG. 11.
Figure 13:
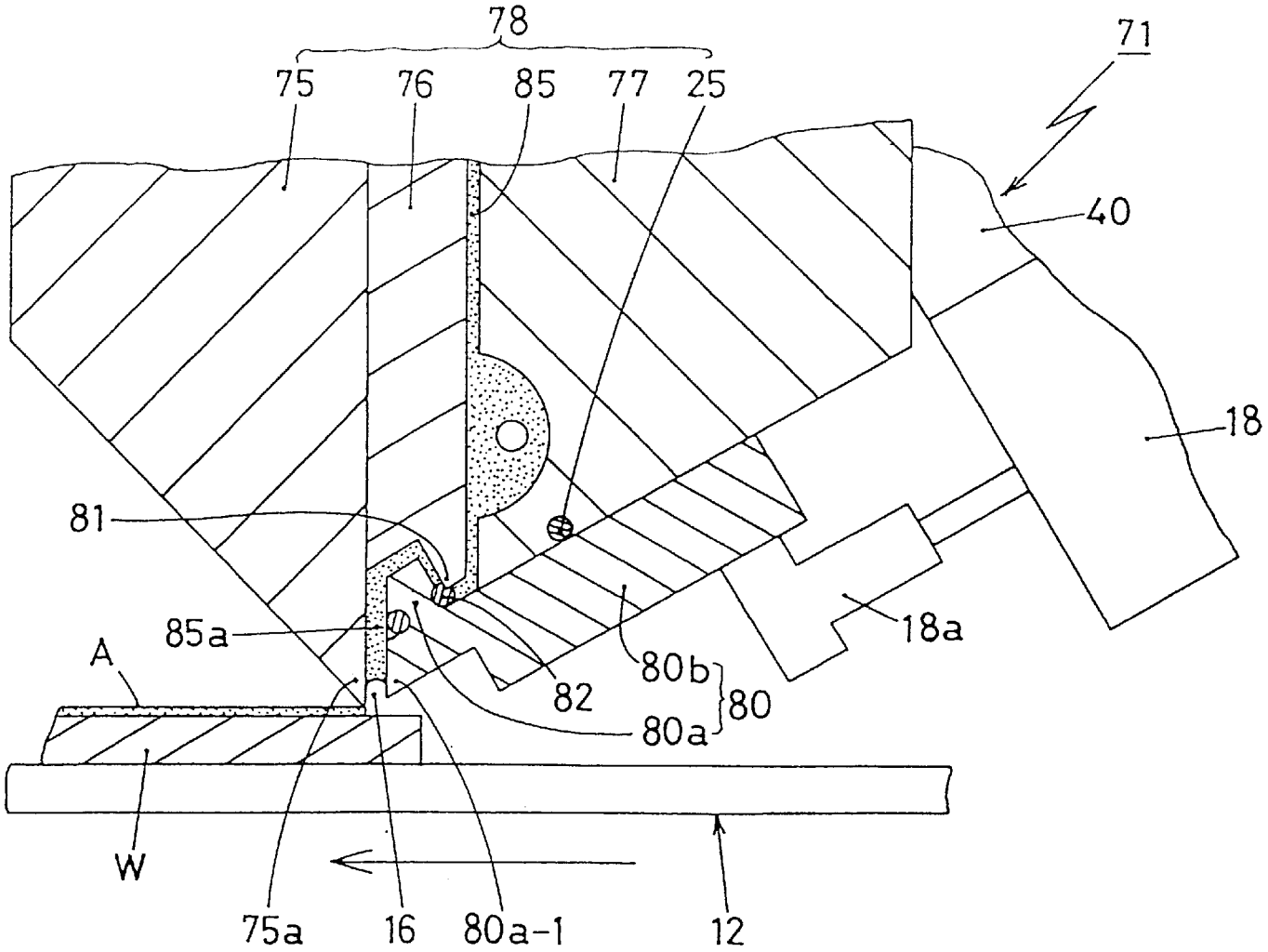
FIG. 13 is an enlarged, partially sectional side view showing essential portions in a state where the valve is made to retract to a seated position and the discharge of coating solution is stopped, according to the fifth embodiment.
Figure 14:
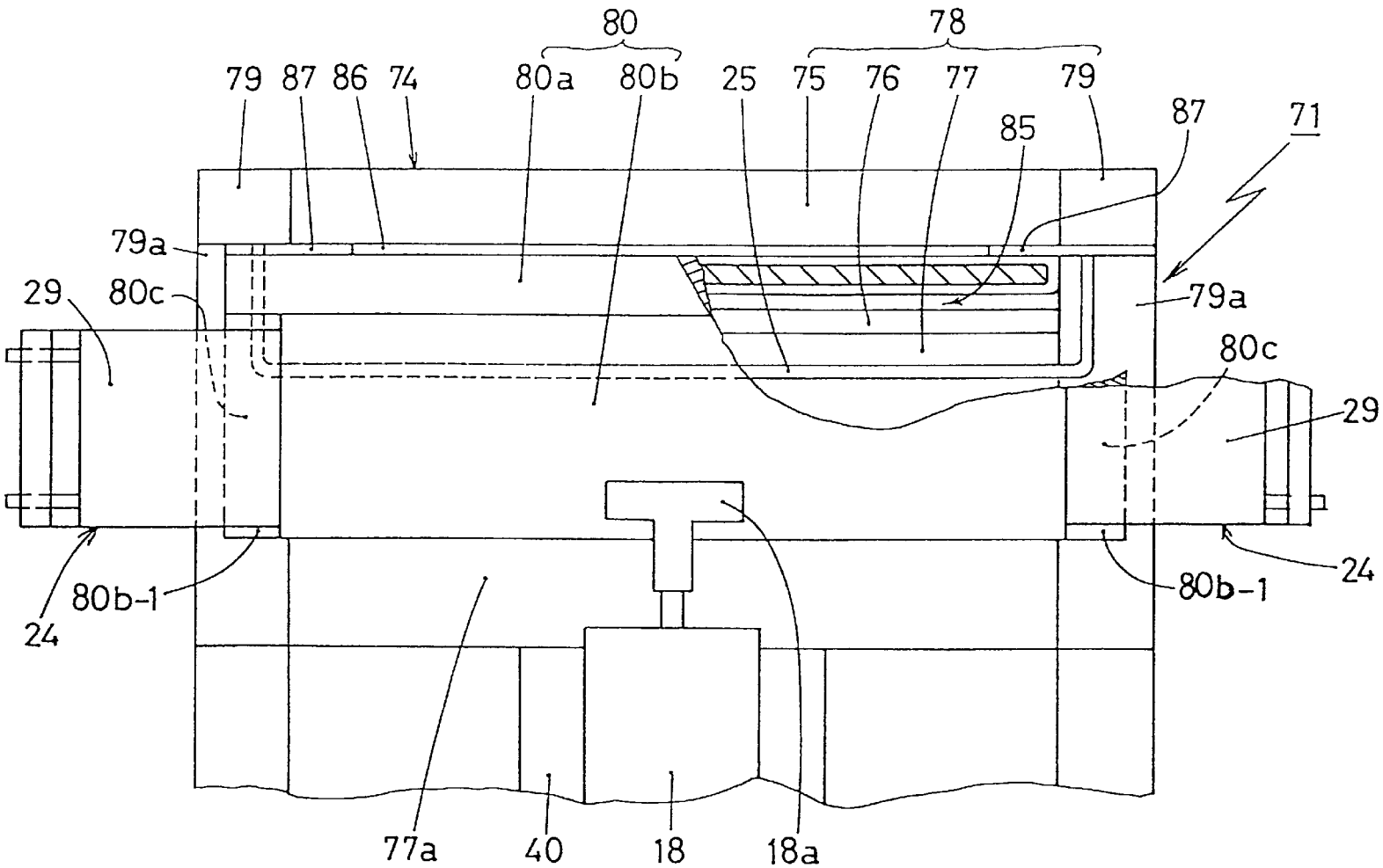
FIG. 14 is a partially sectional bottom view along lines C—C of FIG. 12, but omitting a transfer device and the base material.
Figure 15:
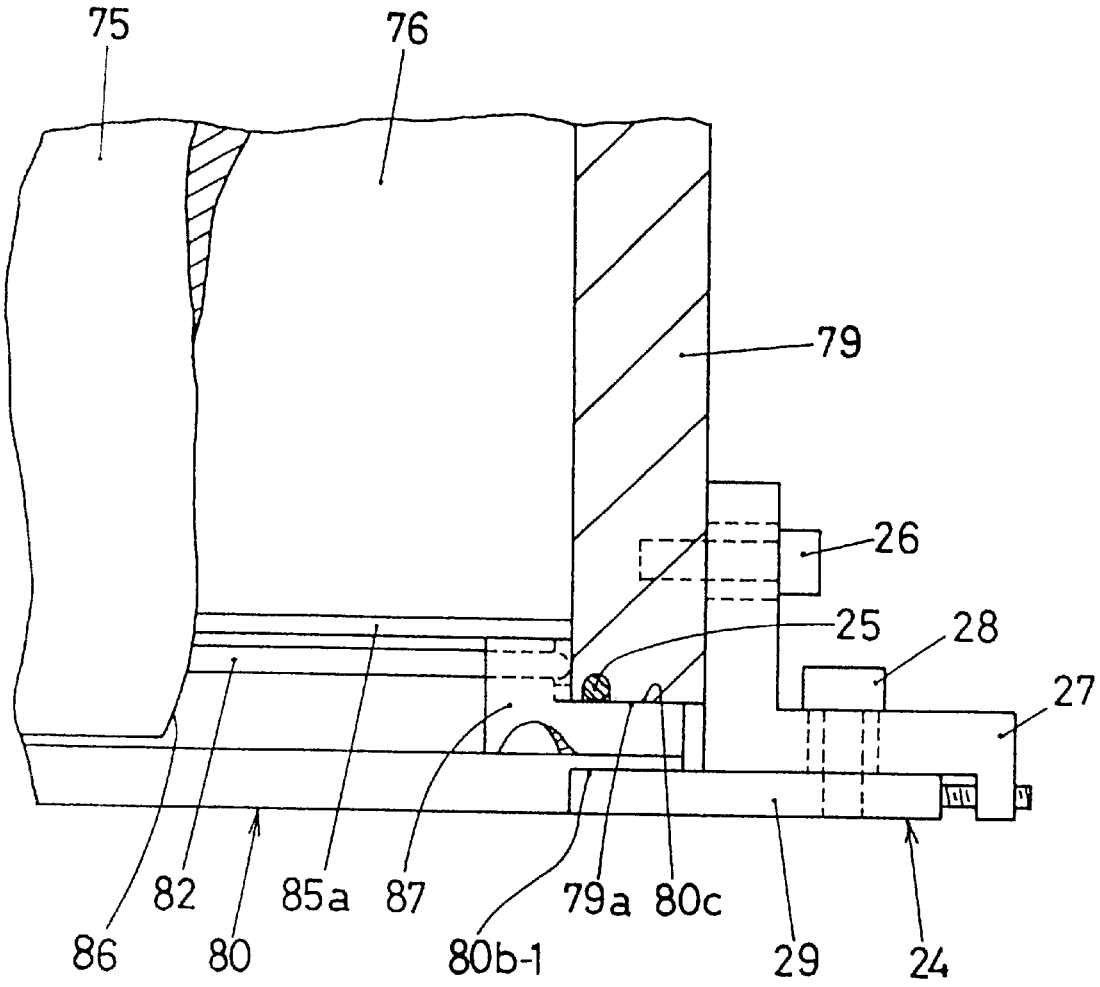
FIG. 15 is an enlarged view of a guide device according to the fifth embodiment.
Figure 16:
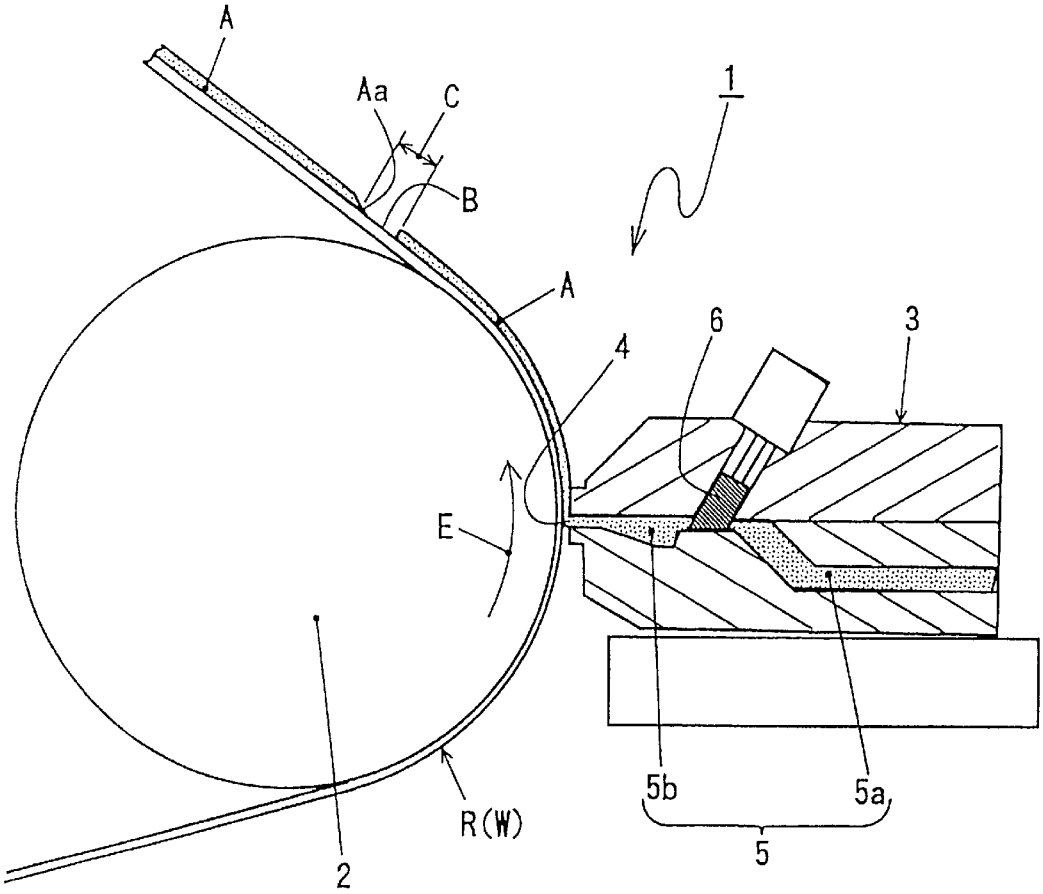
FIG. 16 is an enlarged, partially sectional side view showing essential portions of a conventional coating device.

FIG. 11 through FIG. 15 show Embodiment 5 of the invented device where FIG. 11 is an enlarged, partially sectional view showing essential portions in a state where a valve is made to extend to an unseated position and a coating solution is discharged from a discharge port, FIG. 12 is an enlarged, partially sectional side view showing the essential portions under the same state, FIG. 13 is an enlarged, partially sectional side view showing the essential portions in a state where the valve is made to retract to a seated position and the discharge of the coating solution is stopped, FIG. 14 is a partially sectional bottom view along arrows C—C of FIG. 12 but omitting the transfer device and the base material, and FIG. 15 is an enlarged view of a guiding device.

As illustrated by FIG. 12 a coating device 71 in accordance with this embodiment is provided with the transfer device 12 comprising a belt conveyer, etc. forming the base material transfer path R on the upper face side and a die main body 74 arranged above the transfer device 12. As illustrated by FIG. 11 and FIG. 14, the die main body 74 is provided with a fixed portion 78 in which a lip member 75, an intermediate member 76 and a side member 77 are put together and to both sides of which end plates 79 are bonded, a movable valve 80 and the driving device 18. A front end edge 75*a* of the lip member 75 constitutes a doctoring edge for forming a predetermined coating gap between the lip member 75 and the base material W.

A path 85 for a coating solution is formed between the intermediate member 76 and the side member 77 and a primary manifold, not illustrated, on the upstream side and a secondary manifold 86*b* on the downstream side are installed on the path 85 for a coating solution. Both ends of the secondary manifold 85*b* on the downstream side communicate with the solution discharge paths 31 perforated at the end plates 79. With the die main body 74, the supply pipe 33 of the coating solution supply device 32 illustrated by FIG. 6, is connected to the primary manifold and the recirculation pipe 34 (refer to FIG. 12) of the coating solution supply device 32 is connected to the solution discharge paths 31.

As illustrated by FIG. 11, FIG. 14 and FIG. 15, an abrasively moving portion 80*b* is extended from a valve main body 80*a*, both side edge portions 80*c* are brought into abrasive contact with inclined lower end faces 79*a* of the end plates 79 and the abrasively moving portion 80*b* is brought into abrasive contact with an inclined outer side face 77*a* of the side member 77. Stepped portions 80*b*-1 provided on both edges of short sides of the abrasively moving portion 80*b* are guided by the guiding devices 24.

As illustrated by FIG. 15, each of the guiding devices 24 is provided with the bracket 27 fastened by the screw 26 to the end plate 79 adjustably in respect of the height and the guide plate 29 fastened by the screw 28 to the bracket 27 and the stepped portion 80*b*-1 is abrasively guided by a side edge of the guide plate 29. As illustrated by FIG. 12 and FIG. 14, the driving device 18 for driving the valve 80 to extend and retract uses a solenoid, a linear motor or super-magnetorestrictive actuator, etc., and the output end 18*a* is connected to the valve 80.

As illustrated by FIG. 11 and FIG. 13, the path 85 for a coating solution is extended between the lip member 75 and the intermediate member 76. A slender discharge port 86 facing the base material transfer path R is formed by a front end edge 80*a*-1 of the valve main body 80*a* and a front end edge 75*a* of the lip member 75 to extend in the transverse direction of the transfer path R. A valve seat 81 facing the path 85 for a coating solution is provided at the lower end of the intermittent member 76 along the transverse direction of the path 85 for a coating solution. The valve 80 is made to extend or retract instantaneously by the driving device 18 between an unseated position (refer to FIG. 11) where the path 85 for a coating solution is opened when the valve main body 80*a* moves away from the valve seat 81 and a seated position (refer to FIG. 13) where the path 85 for a coating solution is closed when the valve main body 80*a* is moved into contact with the valve seat 81.

The valve 80 is arranged such that the valve main body 80*a* is separated from the lip member 75 and a volume of a portion 85*a* of the path 85 for a coating solution downstream from the valve seat 81 is increased as the valve 80 moves from the unseated position (refer to FIG. 11) opening the path 85 for a coating solution toward the seated position (refer to FIG. 13) closing the path 85 for a coating solution.

A seal member 82 formed by an elastic material such as gum, etc. is bonded to the valve main body 80*a* whereby when the valve main body 80*a* is seated on the valve seat 81, the path 85 for a coating solution is completely closed by which the coating solution upstream from the valve seat 80 is prevented from leaking to the portion 85*a* of the path 85 for a coating solution downstream therefrom and the outside of the die main body 74. Incidentally, although not illustrated, it is possible to form the seating portion of an elastic material by mounting a seal member to the valve seat 81 and also to form both seating portions of an elastic material by mounting the seal member to both of the valve seat 81 and the valve main body 80*a*. Furthermore, the valve main body 80*a* may be seated on the valve seat 81 and brought into contact with each other in a water tight manner without mounting the seal member to the valve seat 81 and the valve main body 81 a whereby the path 85 for a coating solution is completely closed.

As illustrated by FIG. 14, the valve 80, the end plates 79 and the side member 77 are sealed by a seal member 25 embedded in the end plates 79 and the side member 77 whereby the coating solution invading gaps between the valve 80 and the end plates 79 and between the valve 80 and the side member 77 is prevented from leaking to the outside. Blind plates 87 formed by an elastic material such as gum, etc. are interposed at both respective sides of the discharge port 86. The respective blind plates 87 are always squeezed in a water tight manner by the lip member 75 and the valve main body 80*a* whereby the coating solution is prevented from leaking from a gap between the seal member 82 and the valve main body 80*a* toward the discharge port 86.

Next, an explanation will be given of the coating operation by the coating device 71 in accordance with this embodiment. The valve 80 is made to retract to the seated position (refer to FIG. 13) and is made to stand ready such that the coating solution is not discharged from the discharge port 86.

Next, when the base material W transferred from the transfer device 12 reaches a predetermined coating starting position, the valve main body 80 is made to extend swiftly to the unseated position (refer to FIG. 11) and the coating solution is discharged from the discharge port 86 whereby the coated film A is formed on the base material W. Finally, when the transferring base material W reaches a predetermined coating finishing position, the valve 80 is made to retract swiftly to the seated position (refer to FIG. 13) by operating the driving device 18 whereby the coating solution is stopped discharging from the discharge port 86. In this retracting operation, the volume of the portion 85*a* of the path 85 for the coating solution downstream from the valve seat 81 is increased whereby the coating solution in the vicinity of the discharge port 86 is decompressed and accordingly, the discharge of the coating solution can instantaneously be stopped and the cutting off thereof can be carried out with certainty.

The decompression of the coating solution in the vicinity of the discharge port 86 is as follows. In the procedure of seating the valve main body 80*a* on the valve seat 81, the passing resistance at a narrow gap formed between the valve main body 80*a* and the valve seat 81 immediately before seating is significantly increased whereby the path 85 for the coating solution is substantially closed and in the time period during which the valve main body 80*a* is being moved toward the seating position from this state and is seated, the path 85 for the coating solution is substantially closed and the volume of the portion 85*a* of path 85 for the coating solution downstream from the valve seat 81 is increased and therefore, the coating solution in the vicinity of the discharge port 86 is decompressed.

When the valve main body 80*a* is provided with the elastic seal member 82, the valve member 80*a* immediately after having seated onto the valve seat 81, is moved further to the seating direction while deforming to compress the seal member 82 comprising an elastic member whereby the volume of the portion 85*a* of the path 85 for the coating solution downstream from the valve seat 81 is increased under the state where the path 85 for the coating solution is completely closed by which the coating solution in the vicinity of the discharge port 86 is decompressed and the cutting of solution can be carried out with certainty.

The arrival of one sheet of the base material W that is formed in predetermined dimensions at the predetermined coating starting position or the coating finishing position, is confirmed by sensors, not illustrated, arranged in the vicinity of the transfer device 12. The driving device 18 is operated based on detecting signals issued by the sensors. When both faces of the base material W are intermittently coated, the driving device 18 can be operated based on signals issued by the detecting device 52 as illustrated by FIG. 9.

As has been explained, according to the coating device 71, the path 85 for the coating solution is instantaneously opened or closed by swiftly making the valve 80 be extended or retracted by the driving device 18 and when the path 85 for the coating solution is closed by seating the valve main body 80*a*, the volume of the portion 85*a* of the path 85 for the coating solution downstream form the valve seat 81 is increased by which the coating solution in the vicinity of discharge port 86 is decompressed and the cutting of solution is carried out with certainty. Therefore, the film thickness of the coated film A can be constituted uniformly from the leading end to the trailing end. Furthermore, according to the coating device 71, a portion of the coating solution is discharged from both ends of the manifold 85*b* to the solution discharge paths 31 and therefore, a large amount of the coating solution can be supplied to the manifold 85*b* compared with the case where the solution discharge paths 31 are dispensed with. As a result, according to the coating device 71, the pressure variation of the coating solution present from the manifold 80*b* to the discharge port 86 in the path 85 for the coating solution can be reduced even with the opening or closing of the valve 80 and the coating solution can be discharged uniformly from start to stop of coating whereby the thickness of the coated film A can be made uniform.

Other Embodiments

The die main body 14 illustrated by FIG. 10 may be replaced by the die main body 74 illustrated by FIG. 11. In this case the discharge port 86 can be directed upwardly by arranging the die main body 74 below the back-up roll 62.

As has been described in detail, the invented device achieves the following excellent effects.

According the first aspect of the present invention the discharge port can be opened or closed instantaneously by the shutter and therefore, the film thickness of the coated film can be made uniform from the leading end to the trailing end.

According to the second aspect of the present invention, the path for the coating solution can be opened or closed instantaneously by the valve and when the path for coating solution is closed by the valve, the coating solution in the vicinity of the discharge port is decompressed whereby the cutting of the solution can be carried out with certainty and accordingly, the film thickness of the coated film can be made uniform from the start end to the finish end.

According to the third aspect of the present invention, the cutting of the solution can be carried out with further certainty and accordingly, the film thickness of coated film can be made uniform from leading end to the trailing end.

According to the fourth aspect of the present invention, pressure variation of the coating solution in the path for the coating solution can be reduced and the coating solution can be discharged uniformly from the start to stop of coating even with the opening or closing of the shutter or the opening or closing of the valve and accordingly, the thickness of coated film can be made uniform from start to stop of coating.

According to the fifth aspect of the present invention, the positional relationship among the coated films which are coated on both faces of the base material is made as predetermined whereby the promotion of yield can be achieved.

What is claimed is:

1. A coating device for use in applying a coating solution to a base material moving along a transfer path to form a coated film on the base material, said coating device comprising:

a die main body having a coating solution path formed therein, and a discharge port provided at a discharge end of said coating solution path;

wherein said die main body comprises a fixed portion, a valve seat provided at a portion of said fixed portion, facing said coating solution path and extending along a transverse direction of said coating solution path, and a movable valve, arranged for movement relative to said fixed portion, to be seated and unseated with respect to said valve seat; and a driving device for extending and retracting said movable valve between an unseated position for opening said coating solution path and a seated position for closing said coating solution path;

wherein said coating solution path is formed also between said fixed portion and said movable valve;

wherein said discharge port is formed by a front end edge of said fixed portion and a front end edge of said movable valve, and said movable valve is arranged such that a volume of the coating solution path downstream from said valve seat is increased as said movable valve moves from said unseated position for opening said coating solution path toward said seated position for closing said coating solution path.

2. The coating device according to claim 1, further comprising a seating portion formed of an elastic member and provided on at least one of said valve seat and said movable valve such that, as said movable valve begins seating when being moved toward said valve seat, said movable valve can be further moved toward said valve seat by compressing said elastic member between said valve seat and said movable valve.

3. The coating device according to claim 2, further comprising a manifold provided at a midpoint of said coating solution path upstream of said valve seat, said manifold having opposing ends; and coating solution discharge paths communicated with said opposing ends of said manifold.

4. The coating device according to claim 3, wherein driving device is responsive to detection signals indicating detection of leading and trailing ends of the coated film already formed on the base material.

5. The coating device according to claim 4, further comprising detectors for detecting leading and trailing ends of the coated film already formed on the base material, and supplying the detection signals to said driving device.

6. The coating device according to claim 2, wherein said driving device is responsive to detection signals indicating detection of leading and trailing ends of the coated film already formed on the base material.

7. The coating device according to claim 6, further comprising detectors for detecting leading and trailing ends of the coated film already formed on the base material, and supplying the detection signals to said driving device.

8. The coating device according to claim 1, further comprising a manifold provided at a midpoint of said coating solution path upstream of said valve seat, said manifold having opposing ends; and coating solution discharge paths communicated with said opposing ends of said manifold.

9. The coating device according to claim 1, wherein said driving device is responsive to detection signals indicating detection of leading and trailing ends of the coated film already formed on the base material.

10. The coating device according to claim 9, further comprising detectors for detecting leading and trailing ends of the coated film already formed on the base material, and supplying the detection signals to said driving device.

* * * * *